US007377218B2

(12) United States Patent
Hyacinthe

(10) Patent No.: US 7,377,218 B2
(45) Date of Patent: May 27, 2008

(54) EMERGENCY RESCUE VEHICLE

(75) Inventor: Berg P. Hyacinthe, Tallahassee, FL (US)

(73) Assignee: Infosense Technologies and Research Inc., Sunrise, FL (US)

( * ) Notice: Subject to any disclaimer, the term of this patent is extended or adjusted under 35 U.S.C. 154(b) by 223 days.

(21) Appl. No.: 11/296,608

(22) Filed: Dec. 7, 2005

(65) Prior Publication Data

US 2006/0124023 A1 Jun. 15, 2006

Related U.S. Application Data

(60) Provisional application No. 60/634,637, filed on Dec. 10, 2004.

(51) Int. Cl.
*B61B 15/00* (2006.01)

(52) U.S. Cl. ..... 104/127; 187/239

(58) Field of Classification Search ..... 104/127, 104/128, 138.1; 187/239, 250, 274
See application file for complete search history.

(56) References Cited

U.S. PATENT DOCUMENTS

| | | | | |
|---|---|---|---|---|
| 561,223 | A * | 6/1896 | Hamilton | 104/127 |
| 3,896,736 | A * | 7/1975 | Hamy | 104/127 |
| 5,125,346 | A * | 6/1992 | Piepers | 104/127 |
| 7,191,873 | B2 * | 3/2007 | Korchagin et al. | 187/239 |
| 2004/0262086 | A1 * | 12/2004 | Korchagin et al. | 187/239 |

* cited by examiner

*Primary Examiner*—Lars A Olson

(57) ABSTRACT

The present invention relates to a rescue assembly including a vehicle that rides upon a track operated by a network of pistons set in a left to right array and connected by slanted bridges for control of said capsule. The vehicle, track, and piston network is all contained within a tube and is continuous vertically the entire height of a tall building or structure. The capsule is powered by an independent power source with regards to the building's or structure's power supply and is controlled via straight aerodynamic controls.

12 Claims, 4 Drawing Sheets

EMERGENCY RESCUE VEHICLE

CROSS-REFERENCE TO RELATED APPLICATION

The present application claims the benefit of previously filed now abandoned Provisional Patent Application, Ser. No. 60/634,637 filed Dec. 10, 2004.

FIELD OF INVENTION

This invention relates, generally, to a system and apparatus for the rescue of persons and property or other valuables from high altitudes. More specifically, it performs primary functions using a system of aerodynamics including pressure and pistons, rails and tracks, and a capsule or plurality of said capsules. Said system operates independent of power outage or other events that would warrant the evacuation from tall structures.

BACKGROUND OF THE INVENTION

A growing portion of the population, both workers and residents, dwell in increasingly tall structures, especially in dense urban areas where real estate values have inflated drastically in the past decades. Considering the increased incidence of terrorist attacks as well as the ever present threat of natural disaster and fire dangers, there exists a need for a system to facilitate the quick and safe evacuation of people, pets, and other valuables from tall structures that is safe from the dangers associated with the cause for evacuation as well as having a separate power supply from the building or structure.

Upon a power outage or other events that render building elevators dysfunctional or ineffective, people are forced to use either the stairwells, be air lifted, or use some sort of gondola as attached to the building from another building or via a vehicle on the ground. Each of these evacuation methods has limitations especially when considering smoke inhalation hazards, hot air and turbulence, or height limitations.

Numerous systems and apparatus have been invented to aid in the evacuation of such structures. U.S. Pat. No. 6,793,038 by Meller discloses a method and apparatus for rescuing occupants from high structures using replaceable cable cartridges and dynamic resistance device that includes a frame adjacent an escape portion of the high structure; a dynamic resistance device such as an air fan mounted to the frame; and a removable and replaceable cable cartridge, having a pre-wound cable, which is removably and non-rotatably coupled to a rotatable portion of the dynamic resistance device. The cable is connectable to a person to be evacuated. When the person to be evacuated goes out from the escape portion of the high structure, his descending motion causes the cable to unwind with the same linear speed as the descending speed of the person, thus causing the rotatable portion of the dynamic resistance device to rotate and to create resistance to the descending speed of the person, until the descending speed of the person reaches a substantially equilibrium value.

U.S. Pat. No. 4,709,782 by Lipinski discloses A high-rise fire escape device gravity operated and particularly adaptable for use in high-rise building and modern skyscraper structures. Lipinski describes an apparatus or device comprising of the combination of a vertical skid track member attached to the wall of a building with a skid which is inserted into a guide channel located in the track. As the skid moves down the guide channel of the skid track it comes into fractional contact with the biased plane frictional surface of the plurality of protruding descent retarders disposed along its vertical axis causing the descent retarder to be displaced in a horizontal direction perpendicular to direction of the skid movement. The movement of the descent retarders in a horizontal direction is resisted by means just as a plurality of springs interposed between the rear of the descent retarders and the inside the back portion of the skid track. The person or object to be rescued is strapped onto the track and lowered without the use of a vehicle or cart and is therefore not useful for valuables.

U.S. Pat. No. 6,814,185 by Ostrobrod discloses a descent controller for lowering a workman or other person along a vertically extending rope from an elevated position to a relatively lower position includes a friction device that may be in the form of a cylinder having a plurality of turns of rope wrapped therearound or a plurality of spaced apart horizontal bars with the rope woven between the bars. Ostrobrod goes on to discuss the use of a vertical cylindrical drum or capstan about which a rope is wound and a tapered slot through the drum for receiving and releasably gripping the rope along which descent is made. This apparatus is for a person and will not accommodate other valuables or property.

U.S. Pat. No. 4,469,198 by Crump discloses an outside rescue elevator system shown for use on a high-rise building comprising a dual compartment track mounted vertically on the outside of the building, and a wheeled truck operating within one of the track compartments, and a dual cable system is included with the truck for raising and lowering the truck within the track. A portable elevator cab is connected to the truck, and the cab includes a pair of stabilizing wheels, so that the cab actually rides on a smooth vertical roadbed that extends up the exterior wall of the building. The elevator cab is provided as part of a mobile unit which includes a self-propelled truck, a motor/generator set mounted on a trailer that is pulled by the truck, so that the mobile unit may be stored in a remote location such as a fire department station house, and brought to the scene of a fire emergency at one of a plurality of high-rise buildings that is serviced by this safety system.

U.S. Pat No. 4,433,752 by Gunter discloses a fire-proof rescue system for high-rise buildings comprises an upright rail fixed to a face of the building and a rescue cabin movable upwardly and downwardly of the building and having a gear engageable with the rail. The system further includes a gear transmission unit, a cable drum with a cable thereon, and a deflecting roller mounted above the rail and operative for taking up the cable from the cable drum. The transmission unit may be a gear transmission unit equipped with a motor and connected to the climb gear and to the cable drum, respectively.

U.S. Pat. No. 4,424,884 by Smith, Jr. discloses an emergency rescue system for use in rescuing persons trapped in the upper floors of a multistory building during emergency conditions comprising a rescue gondola suspended alongside the exterior face of the building by a suspension cable. The suspension cable is secured to a carriage at the top of the building wherein the carriage includes means for adjusting the length of the suspension cable to adjust the elevational position of the gondola, and the carriage is movable along a track at the top of the building to adjust the lateral position of the gondola.

None of these apparatus describe an emergency rescue vehicle that operates like an elevator using aerodynamics independent of power outages that will deliver people or valuables form tall building or high altitudes and protecting said people or valuables from fire or biochemical attack.

Therefore, there is a need for an emergency rescue vehicle that operates like an elevator within a protective tube via a system of aerodynamic pressure pistons, tracks, rails and independent capsules independent of power outages.

It is the object therefore of this invention to provide an Emergency Rescue Vehicle that rides on at least 2 rails with appropriate tracks thereon in parallel that are continuous from the top of a tall structure to the base of said structure with said rails being permanently attached to the structure.

It is another object of this invention to have at least one (1) but most likely a plurality of vehicles such as capsules that travel on said track with the vertical movement controlled via pressure pistons regulated by aerodynamic protocols or Straight Aerodynamics (SAD).

It is another object of this invention to provide a main shaft comprised of pistons that are staggered in a left right assemblage and connected by slanted bridges allowing said main shaft of the capsule to alternate right and left shifts guiding the vehicle to its destination.

It is yet another object of this invention that the capsule be stored in a type of closet and that said capsule is able to rotate in and out of the building through an open surface on one of the rails of the track.

It is yet another object of this invention that the totality of the rescue vehicle (track, rail, capsule, and pressure pistons) be enclosed within a large tube that is proportional to the building height in order to protect persons of valuables from smoke or bio-terrorism attacks.

It is yet another object of this invention to provide a capsule with other equipment such as air conditioning, cameras, microphones, or biochemical sensors or spectrometers as desired.

It is yet another object of this invention to provide the rescue system that is flexible and able to be modified for roof rescues, attachment to emergency vehicles such as Fire Engines, etc.

It is yet another object of this invention that the vehicle or capsule is rocket propelled and GPS guided.

This and other objects of the invention will in part be obvious and will in part appear hereinafter.

BRIEF DESCRIPTION OF THE FIGURES

The invention will now be described, by way of example only, with reference to the accompanying figures in which.

Items of the figures and specification.

1. Capsule
2. Tube
3. Piston
4. Rail
5. Rail Hooks
6. Slanted bridge
7. Hydraulic fluid storage container
8. Disc or platform
9. Driveshaft Hooks
10. Driveshaft
11. Capsule door

SUMMARY OF THE INVENTION

This invention relates to an Emergency Rescue Vehicle, specifically an Emergency Rescue Vehicle (ERV) that utilizes specialized vehicles such as capsule(s), platforms, discs, or other such objects that can carry people or valuables in order to traverse the vertical side of a large building or structure via permanently affixed rails and hydraulic shaft. Said vehicle(s) operate via straight aerodynamic (SAD) pressure and pistons, and are contained within a large large building or structure via permanently affixed rails and hydraulic shaft. Said vehicle(s) operate via straight aerodynamic (SAD) pressure and pistons, and are contained within a large tube. Up and down movement is controlled, or regulated, by aero-electronics and powered by a separate power supply from that of the building.

The assembly is meant to function in the case of power outage or other event that renders a building's elevators dysfunctional or ineffective. The vehicle is designed to hold a pre-estimated amount of weight (people), is configured such that it slides down a series of tracks that are attached permanently to the building and laid in parallel similar to train tracks, bringing the load to safety on the ground or below ground in a safety bunker.

An open surface similar to a wall air conditioner unit installation allows the vehicle and its housing to rotate in-and-out of the building while the rails secure the vertical motion of the capsule. The forces that control upward and downward mobility are powered by very strong pistons within a center control rail of pistons and slanted bridges. The pistons are regulated by aerodynamic protocols well known to those skilled in the art.

Primary pistons connected by a slanted bridge operate as a built in control rail that allows the driveshaft of the vehicle to alternate right and left shifts as the driveshaft switches from one piston to the other thereby guiding the vehicle to its destination. A giant tube appropriate to the size of the capsule and building height shields the capsule during its movement. Said tube is preferably clear in order to monitor the activities inside of the tube during the rescue operation. Other optional equipment may be added including cameras, sensors, microphones, air filtration units, defibrillators, telephones, etc. however the availability of such options can be severely limited by certain types of disasters and attacks.

Upon reaching its final destination, the people or payload exits the ERV via two sets of doors; the vehicle door and subsequently the tube exit.

DESCRIPTION OF THE PREFERRED EMBODIMENT

Figure 1:
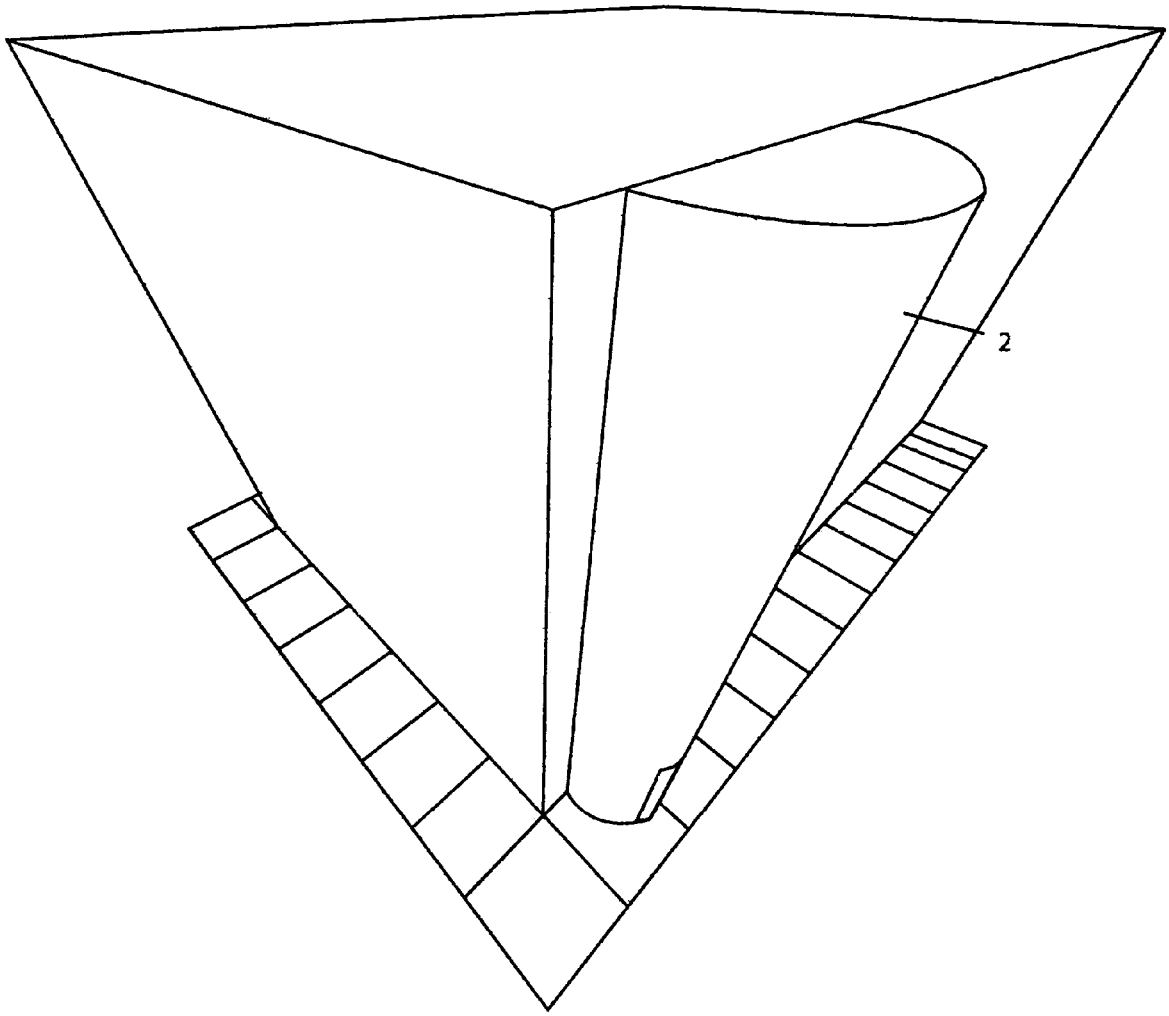
FIG. 1 an environmental overview of the emergency rescue vehicle as shown attached to a tall building.
Figure 2:
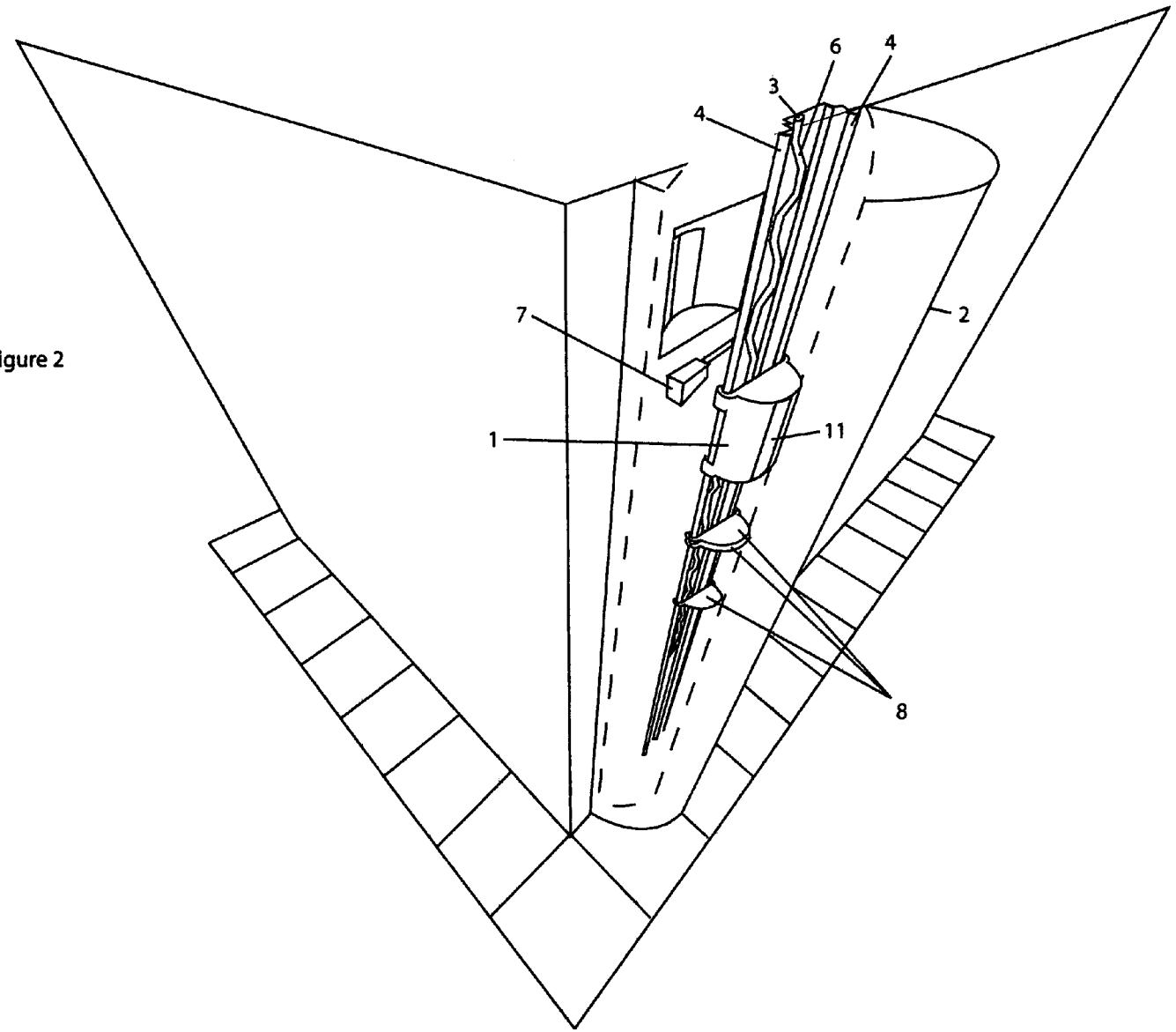
FIG. 2 depicts a cut away from the tube exposing the main shaft, track and vehicle.

The present invention as shown in FIGS. 1 and 2 is an assembly comprised of a capsule (1) that rides on a track, specifically two rails (4) in either an up or down motion. The capsule (1) and rails (4) as well as all the aerodynamic controls are enclosed within a giant tube (2) that is preferably clear. The capsule (1) is stored within the building and is rotated out to the tube (2) when needed. The capsule (1) is then engaged to the rails (4) and begins its movement via a network of pistons (3) located in a left to right pattern in between the two rails (4) of the track.

FIG. 2 further shows a cutaway of the tube (2) with a depiction of the track assembly of rails (4) and control rail containing the network of pistons (3). The pistons (3) act as the primary motile element of the assembly and also as shock absorbers for the capsule (1) as the capsule (1) travels towards its ultimate destination, be that the roof, another floor, the ground, or underground bunker. The pistons (3) are staggered in a left to right manner and are connected via a slanted bridge (6) in order to facilitate control of the velocity. Contained within the network of pistons (3) there are periodic hydraulic fluid storage containers (7) to supply hydraulic fluid to, or remove hydraulic fluid from the pistons (3).

Figure 3:
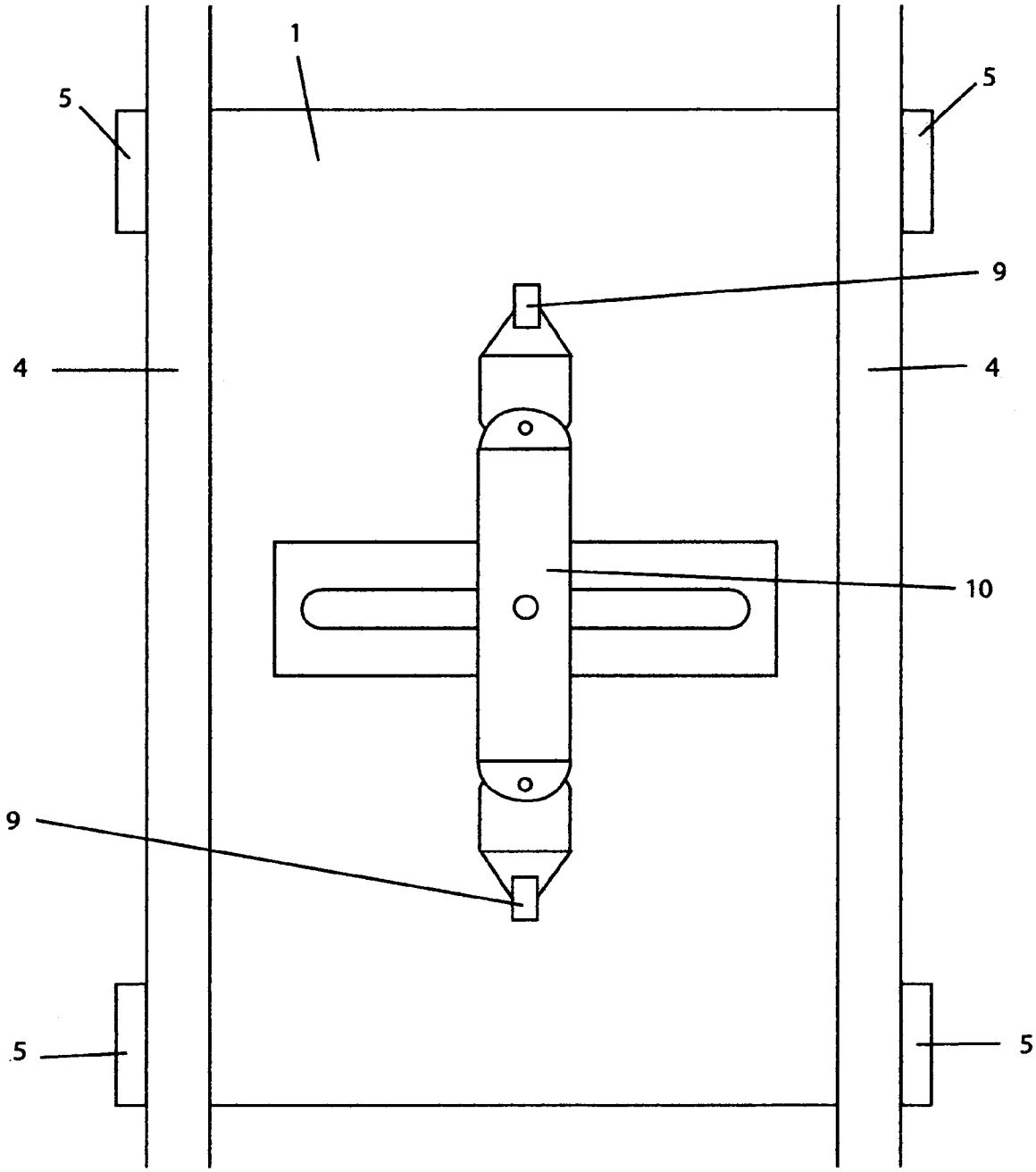
FIG. 3 shows a back view of the capsule.

FIG. 3 shows a back view of a capsule (1) wherein the capsule (1) is attached to the rails (4) by a series of rail hooks (5) and the network of pistons (3) by the driveshaft (10) using driveshaft hooks (9).

Figure 4:
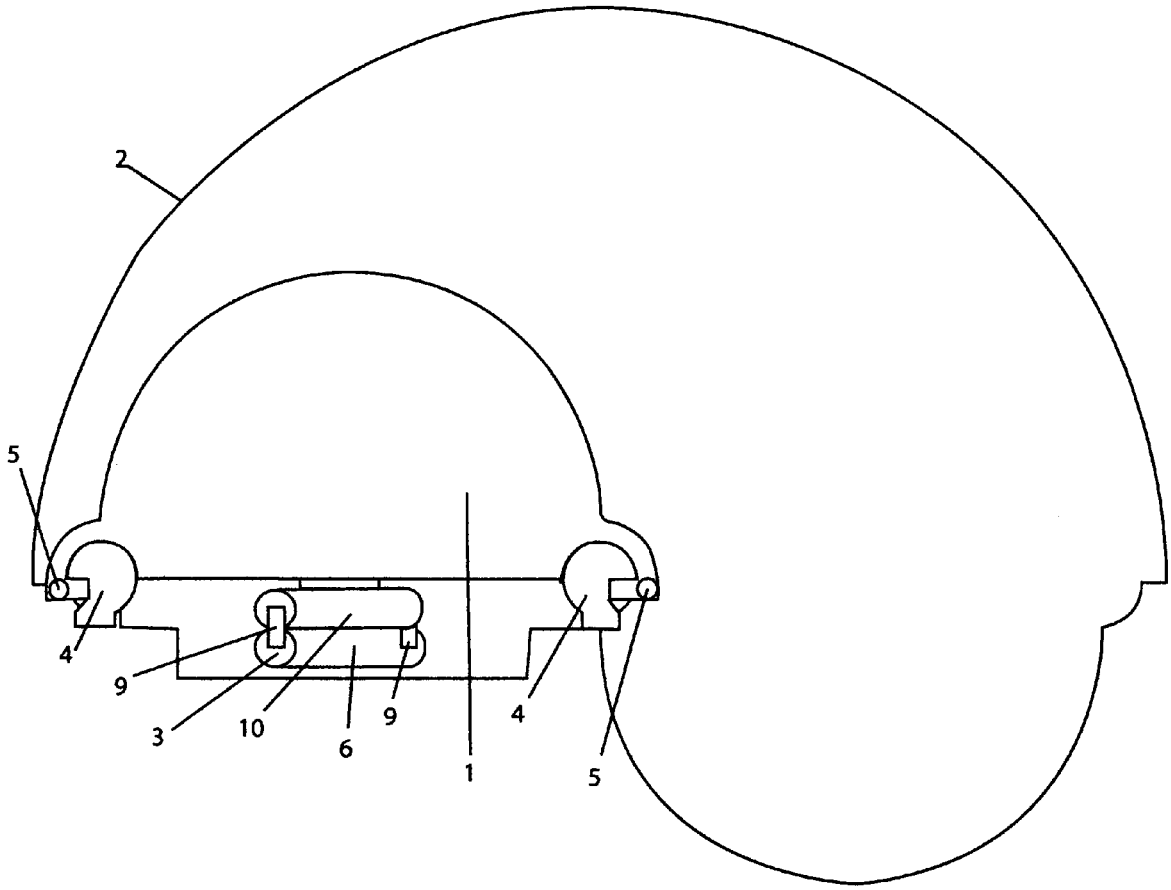
FIG. 4 is a top view which shows the capsule storage room adjacent to the shaft and track.

FIG. 4 shows the tube (2) containing the capsule (1), the rails (4) and pistons (3) adjacent to a compartment within the building which contains a capsule (1) while setting in storage. To use the capsule (1), a door in the building is opened along with the capsule door (11), people enter, and the capsule (1) is rotated out of storage and hooked onto the rails (4) via the rail hooks (5) and driveshaft (10) via the driveshaft hooks (9). The capsule (1) moves as described above to the bottom of the tube (2) where the capsule door (11) is opened along with an adjacent door in the tube (2). The capsule (1) can re-ascend the building using the pistons (3) in an alternating motion in the same manner as lowering the capsule (1).

An alternate embodiment is also disclosed wherein the capsule (1) is replaced by one or a series of discs or platforms (8). Said disks (8) attach to the rails (4) and pistons (3) via rail hooks (5) and driveshaft hooks (9) as in the capsule embodiment, however the discs (8) are able to be stacked in the storage area and upon reaching the bottom of the tube (2).

Further embodiments of the Emergency Rescue Vehicle include the use of low range powered rocket motors attached to the vehicle as a power source allowing the vehicle to navigate through the use of GPS or customized positioning systems without the control rail and pistons.

The use of a retractable ladder with a metallic bed frame that links to emergency rescue vehicles such as fire trucks, or the addition of a low-tech slider similar to a playground slide, added by means common in the art, would further facilitate rescue thereby having the evacuated people or property coming directly to emergency response personnel rather than exiting in a bunker or on the ground close to the building. These extendable ladders are also capable of extending upward towards rescuing air vehicles and the extendable ladders are further capable of automatically extending without the assistance of the person on the ladder.

Other optional equipment and peripheral materials are provided for and around the emergency rescue system. Equipment that may be added to the vehicle itself includes air conditioning units, oxygen tubes, surveillance systems with communication devices, or other equipment common to the art. The addition of an underground bunker would facilitate the safe unloading of people or property away from danger and a capsule or vehicle loader would facilitate emergency loading on top of the structure.

Although this invention has been described in the form of a preferred embodiment, many modifications, additions, and deletions, may be made thereto without departure from the spirit and scope of the invention, a set forth in the following claims.

What is claimed is:

1. An emergency rescue vehicle to remove people from multistory structures in the event of a power failure or emergency event comprising:

two parallel rails attached vertically on the side of a multistory structure and extending the height of the multistory structure;

a series of hydraulically operated pistons attached to the multistory structure and placed between said parallel rails in a continuous alternating zig zag pattern and extending the length of said parallel rails;

a series of hydraulic fluid storage containers attached to the multistory structure and placed between said parallel rails and in hydraulic connection with said series of pistons;

a capsule said capsule having a capsule door for allowing people to enter said capsule;

said capsule rotatably attached to one of said parallel rails and removably attachable to the second of said parallel rails;

one or more capsule storage openings in said multistory structure and adjacent to said parallel rails such that said capsule can be removably attached from said second parallel rail and rotated around said first parallel rail into said capsule storage area for loading of people into said capsule through said capsule door in an emergency;

said capsule having a driveshaft located on the side of the capsule facing the multistory structure when said capsule is attached to said parallel rails with said driveshaft being capable of being removably attached to said series of pistons when said capsule is rotated out of said capsule storage opening and attached to said second parallel rail;

said driveshaft movably attached to said capsule and capable of rotating around an axis point and also sliding back and forth horizontally the width of said zig zag pattern of said pistons such that when said driveshaft is attached to said series of pistons and rotates and moves back and forth said capsule can be lowered or raised by contraction or expansion of said series of pistons being emptied or filled with hydraulic fluid from said fluid storage containers;

a semi cylindrical tube attached vertically to said multistory structure such that said semi cylindrical tube extends out from said building and encloses said parallel rails, said capsule, and said capsule storage openings; and, a tube door in said semi cylindrical tube for allowing exit of people once said capsule has moved to a safe location and people have exited through said capsule door into said semicircular tube.

2. The emergency rescue vehicle of claim 1 wherein said capsule is constructed of a clear material.

3. The emergency rescue vehicle of claim 1 wherein said semi cylindrical tube is constructed of a clear material.

4. The emergency rescue vehicle of claim 1 wherein said capsule is GPS guided.

5. The emergency rescue vehicle of claim 4 wherein said capsule is powered by one or more rocket motors attached to said capsule allowing further movement separate from said parallel rails.

6. The emergency rescue vehicle of claim 1 wherein said capsule is air conditioned.

7. The emergency rescue vehicle of claim 1 wherein said capsule contains a communication device.

8. The emergency rescue vehicle of claim 1 wherein said semi cylindrical tube further comprises extendable ladders or slides attached at said tube door to facilitate rescue.

9. The emergency rescue vehicle of claim 8 wherein said extendable ladders are capable of extending upward towards rescuing air vehicles and said extendable ladders are further capable of automatically extending.

10. The emergency rescue vehicle of claim 1 further comprising an underground bunker wherein said parallel rails, series of pistons, and semi cylindrical tube would extend below ground level of the multistory building into said underground bunker such that people could exit the emergency rescue vehicle into said underground bunker.

11. The emergency rescue vehicle of claim 1 wherein said capsule is replaced by one or more platforms that would be capable of being stacked in said capsule storage opening and at the safe location.

12. The emergency rescue vehicle of claim 1 wherein any power supplied to said emergency rescue vehicle is supplied from a source separate from the multistory structure.

* * * * *